US009612081B2

(12) United States Patent
Maeda

(10) Patent No.: US 9,612,081 B2
(45) Date of Patent: Apr. 4, 2017

(54) CARTRIDGE FOR AIR GUN

(71) Applicant: Maruzen Company Limited, Tokyo (JP)

(72) Inventor: Tetsuo Maeda, Tokyo (JP)

(73) Assignee: MARUZEN COMPANY LIMITED, Tokyo (JP)

( * ) Notice: Subject to any disclaimer, the term of this patent is extended or adjusted under 35 U.S.C. 154(b) by 0 days.

(21) Appl. No.: 14/562,176

(22) Filed: Dec. 5, 2014

(65) Prior Publication Data

US 2016/0025446 A1 Jan. 28, 2016

(30) Foreign Application Priority Data

Jul. 23, 2014 (JP) ..... 2014-150086
Sep. 17, 2014 (JP) ..... 2014-189357

(51) Int. Cl.

| | |
|---|---|
| ***F42B 39/08*** | (2006.01) |
| ***F41A 9/79*** | (2006.01) |
| ***F41B 11/55*** | (2013.01) |
| ***F41A 9/46*** | (2006.01) |
| ***F41A 9/29*** | (2006.01) |
| ***F42B 39/26*** | (2006.01) |
| ***F41B 11/50*** | (2013.01) |

(52) U.S. Cl.

CPC ..... *F41B 11/55* (2013.01); *F41A 9/29* (2013.01); *F41A 9/46* (2013.01); *F41B 11/50* (2013.01); *F42B 39/087* (2013.01); *F42B 39/26* (2013.01)

(58) Field of Classification Search

CPC .. F41B 11/55; F41B 11/62; F41A 9/76; F41A 9/04; F42B 39/08; F42B 39/085; F42B 39/087

USPC ..... 124/41.1, 45, 48, 52, 82; 89/33.1, 33.14, 89/33.2, 34, 35.01; 42/49.01

See application file for complete search history.

(56) References Cited

U.S. PATENT DOCUMENTS 814,635 A * 3/1906 Young et al. ..... F42B 39/08 89/35.01
2,022,685 A * 12/1935 Moore ..... F42B 39/08 59/8

(Continued)

FOREIGN PATENT DOCUMENTS

EP 1265049 A1 12/2002

OTHER PUBLICATIONS

Extended Search Report issued in European Application No. 14004121.1, dated Nov. 26, 2015.

(Continued)

*Primary Examiner* — Alexander Niconovich
(74) *Attorney, Agent, or Firm* — Michael Best & Friedrich LLP

(57) ABSTRACT

Disclosed is a cartridge for an air gun that facilitates the loading of a bullet into the cartridge. The cartridge includes cylindrical unitary cartridges into which bullets are to be inserted, a cartridge assembly in which the unitary cartridges are coupled to each other and continuously disposed between both ends to form a strip shape, and a magazine case that houses the cartridge assembly. The cartridge assembly is transported by a cartridge transport unit. Further, the unitary cartridges each include two cylindrical parts. The cylindrical parts of neighboring unitary cartridges are sequentially fit-coupled to each other in order to form the cartridge assembly.

14 Claims, 15 Drawing Sheets

(56) References Cited

U.S. PATENT DOCUMENTS 2,086,339 A * 7/1937 Sosso ..... F41A 9/65 42/49.01
2,173,837 A * 9/1939 Gorton ..... F42B 39/08 89/33.2
2,401,050 A * 5/1946 Cooper ..... F42B 39/08 89/35.01
2,480,950 A * 9/1949 Murphy ..... F42B 39/08 89/35.01
2,648,258 A * 8/1953 Simpson ..... F41A 9/30 89/33.25
2,708,390 A * 5/1955 Burns ..... F42B 39/08 89/35.01
2,733,640 A * 2/1956 Gilligan ..... F42B 39/08 86/1.1
3,229,584 A 1/1966 Zehnder
3,253,512 A * 5/1966 Schallehn ..... F42B 39/08 89/35.01
3,254,565 A * 6/1966 La Fever ..... F42B 39/08 403/150
3,318,245 A * 5/1967 Giampiero ..... F42B 39/085 102/281
3,377,919 A * 4/1968 Clark ..... F42B 39/08 89/35.01
3,501,996 A * 3/1970 Lipp ..... F41A 9/16 89/34
3,670,863 A * 6/1972 Meier ..... F41A 9/04 198/803.13
3,759,136 A * 9/1973 Fammler ..... F41A 9/54 193/33
3,788,189 A * 1/1974 Sachleben, Sr. ..... F41A 9/80 193/25 AC
3,901,123 A * 8/1975 Jayne ..... F41A 9/29 89/33.2
3,960,053 A * 6/1976 Conley ..... F41A 9/33 89/149
4,586,423 A * 5/1986 Stauffacher ..... F42B 39/08 89/35.01
4,619,181 A * 10/1986 Pehker ..... F41A 9/76 89/34
4,790,231 A * 12/1988 Stoner ..... F42B 39/087 89/35.02
4,819,609 A 4/1989 Tippmann
4,841,837 A * 6/1989 Novet ..... F41A 9/76 89/33.25
4,872,391 A * 10/1989 Stoner ..... F41A 9/45 42/15
4,873,911 A * 10/1989 Suchocki ..... F41A 9/76 89/34
4,885,976 A * 12/1989 Nordmann ..... F41A 9/04 89/33.2
4,942,802 A * 7/1990 Stoner ..... F41A 9/32 42/25
5,131,315 A * 7/1992 Maher ..... F41A 9/76 89/33.1
5,295,320 A 3/1994 Svensson
5,347,908 A * 9/1994 Mouterde ..... B65G 23/14 89/34
5,368,526 A * 11/1994 Hynes ..... F16G 5/16 474/207
5,398,590 A * 3/1995 Snyder, Sr. ..... F42B 39/08 89/33.02
5,546,845 A * 8/1996 Wossner ..... F42B 39/08 89/35.01
5,660,159 A * 8/1997 Clayton ..... F41B 11/54 124/59
5,945,624 A * 8/1999 Becker ..... F41A 9/64 89/1.59
6,430,861 B1 * 8/2002 Ayers ..... F41A 19/63 102/201
6,494,194 B2 * 12/2002 Shipachev ..... F41A 9/76 124/31
6,796,300 B2 * 9/2004 Petrosyan ..... F41B 11/55 124/48
7,406,907 B1 * 8/2008 Goon ..... F42B 39/08 89/34
7,406,908 B1 * 8/2008 Goon ..... F42B 39/08 89/34
7,568,421 B2 * 8/2009 Cummings ..... F41A 9/49 42/87
7,765,997 B2 * 8/2010 Klockener ..... F41A 9/76 124/48
7,963,280 B2 * 6/2011 Maeda ..... F41B 11/54 124/45
8,011,355 B2 * 9/2011 Kawashima ..... F41B 11/55 124/57
8,037,801 B2 * 10/2011 Coiffet ..... F41A 9/54 89/33.14
8,061,256 B1 * 11/2011 Kurz ..... F42B 39/08 89/33.2
8,146,281 B2 * 4/2012 Zimmerman ..... F41B 11/89 124/1
8,151,684 B2 * 4/2012 Buechler ..... B64D 7/06 89/33.1
8,342,072 B2 * 1/2013 Abbott ..... F41A 9/29 89/33.2
8,402,958 B2 * 3/2013 Victor ..... F41A 9/73 124/45
8,807,008 B2 * 8/2014 Padgett ..... F42B 5/313 89/33.14
8,839,771 B2 * 9/2014 Tseng ..... F41A 9/67 124/40
8,863,633 B2 * 10/2014 Gotie ..... F41A 9/34 89/33.14
2007/0044363 A1 * 3/2007 McClellan ..... F41A 9/85 42/87
2015/0300761 A1 * 10/2015 Delury ..... H04L 67/306 89/33.2

OTHER PUBLICATIONS

Search Report issued in Taiwanese Patent Application No. 104123772, dated Sep. 7, 2016.

* cited by examiner

CARTRIDGE FOR AIR GUN

CROSS-REFERENCE TO RELATED APPLICATION(S)

This application is based upon and claims the benefit of priority from Japanese Patent Applications JP2014-150086 filed on Jul. 23, 2014, and JP2014-189357 filed on Sep. 17, 2014, the entire disclosure of which are incorporated herein by reference.

TECHNICAL FIELD

The present invention relates to an air gun. Specifically, the present invention relates to a bullet feed mechanism that feeds BBs or other bullets to an air gun that uses air or other gas. More specifically, the present invention relates to a cartridge for an air gun.

BACKGROUND ART

A conventionally known bullet feed mechanism that feeds BBs or other bullets to an air gun is shown in FIG. 9 and following drawings in U.S. Pat. No. 7,963,280. In the bullet feed mechanism for an air gun that is shown in FIG. 9 and following drawings of the Patent Document 1, a rotary clip 2 is formed of a circular disc and a plurality of holes 21 are formed around the outer circumference of the rotary clip 2. A bullet W is inserted into each of the holes 21. The rotary clip 2 is attached to an air gun main body 1.

As the rotary clip 2 is attached to the air gun main body 1, bullets W have to be inserted, one by one, into the holes 21 while the rotary clip 2 is rotated.

Meanwhile, a plurality of projectile supports (2) described in U.S. Pat. No. 7,765,997 are attached to an endless transport belt (4).

In the invention described in U.S. Pat. No. 7,963,280, the rotary clip 2 is attached to the main body 1. Therefore, bullets W have to be inserted, one by one, into the holes 21 while the rotary clip 2 is rotated. Eventually, it is found that inserting the bullets W is troublesome.

In the invention described in U.S. Pat. No. 7,765,997, the projectile supports (2) need to be attached to the endless transport belt (4) in order to ensure that the projectile supports (2) are continuously disposed. It means that an endless belt needs to be prepared in addition to the projectile supports (2).

Further, projectiles (3) have to be inserted, one by one, into the projectile supports (2) while the transport belt (4) is rotated. Eventually, it is found that inserting the projectiles (3) is troublesome.

SUMMARY OF INVENTION

The present invention has been made to form a cartridge assembly by attaching cartridges to each other without separately using the transport belt (4), which is an endless belt. The present invention has also been made to facilitate the loading of bullets into the cartridges.

The present invention provides the following embodiments.

A cartridge for an air gun, wherein unitary cartridges into which bullets are to be inserted are pivotally coupled to each other to form a cartridge assembly in which cartridges are continuously disposed.

A cartridge for an air gun, wherein unitary cartridges into which bullets are to be inserted are directly pivotally coupled to each other to form a cartridge assembly in which cartridges are continuously disposed.

A cartridge for an air gun, wherein unitary cartridges into which bullets are to be inserted are pivotally coupled to each other to form an endless strip-shaped cartridge assembly in which cartridges are continuously disposed.

A cartridge for an air gun, wherein unitary cartridges into which bullets are to be inserted are directly pivotally coupled to each other to form an endless strip-shaped cartridge assembly in which cartridges are continuously disposed.

A cartridge for an air gun, comprising:

cylindrical unitary cartridges into which bullets are to be inserted; and a cartridge assembly in which the unitary cartridges are coupled to each other and continuously disposed, wherein the cartridge assembly is transported by a cartridge transport unit.

A cartridge for an air gun, comprising:

cylindrical unitary cartridges into which bullets are to be inserted and whose outer circumference is provided with a latch; and a cartridge assembly in which the unitary cartridges are coupled to each other and continuously disposed, wherein the cartridge assembly is transported by a cartridge transport unit that is latched by the latch.

Alternatively, a cartridge for an air gun, comprising:

cylindrical unitary cartridges into which bullets are to be inserted;

a cartridge assembly in which the unitary cartridges are coupled to each other and continuously disposed; and a magazine case that houses the cartridge assembly, wherein the cartridge assembly is transported by a cartridge transport unit.

Alternatively, a cartridge for an air gun, comprising:

cylindrical unitary cartridges into which bullets are to be inserted;

a cartridge assembly in which the unitary cartridges are coupled to each other and continuously disposed to form a strip shape; and a magazine case that houses the cartridge assembly, wherein the cartridge assembly is transported by a cartridge transport unit.

Further,

A cartridge for an air gun, wherein the cartridge assembly is formed by using a connector that fit-couples neighboring unitary cartridges to each other.

Further,

A cartridge for an air gun, wherein each of the unitary cartridges is formed of two cylindrical parts, the outer circumference of the leading end of each cylinder has a small diameter, and the cartridge assembly is formed by fit-coupling a connector to the leading end of the cylinders of neighboring unitary cartridges.

Further,

A cartridge for an air gun, wherein the cartridge assembly is formed by sequentially fit-coupling neighboring unitary cartridges to each other.

Further,

A cartridge for an air gun, wherein each of the unitary cartridges is formed of two cylindrical parts, and the cartridge assembly is formed by sequentially fit-coupling the cylinders of neighboring unitary cartridges to each other.

Further,

A cartridge for an air gun, wherein the cartridge transport unit is attached to the magazine case.

According to the present invention, unitary cartridges into which bullets are to be inserted are pivotally coupled to each other to form a cartridge assembly in which the cartridges are continuously disposed. Therefore, the cartridges are transformably coupled to each other without requiring a separate member. Thus, the cartridge assembly is transformable.

Further, the present invention makes it easy to load the bullets into the cartridges.

DESCRIPTION OF EMBODIMENTS

Embodiments of the present invention will now be described with reference to the accompanying drawings. A first embodiment of the present invention will be described below with reference to FIGS. 1 to 9.

Figure 6:
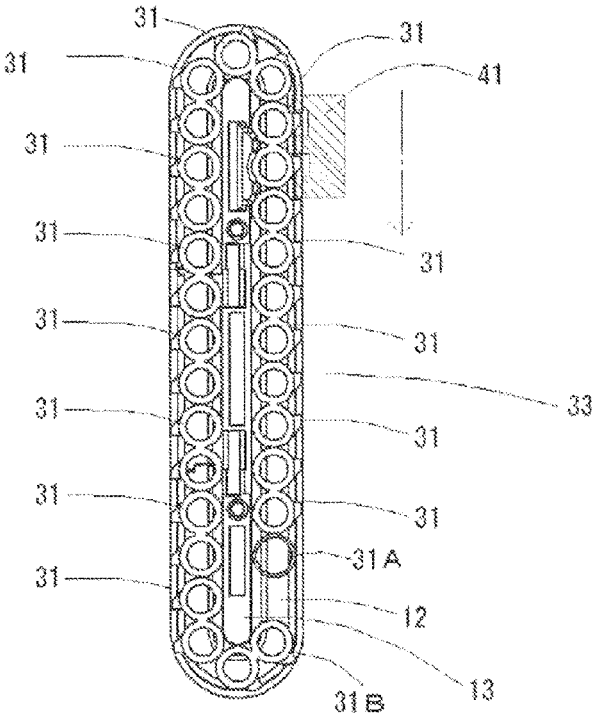
FIG. 6 is a front cross-sectional view illustrating the air gun magazine case when it houses the air gun cartridge assembly according to the first embodiment.
Figure 7:
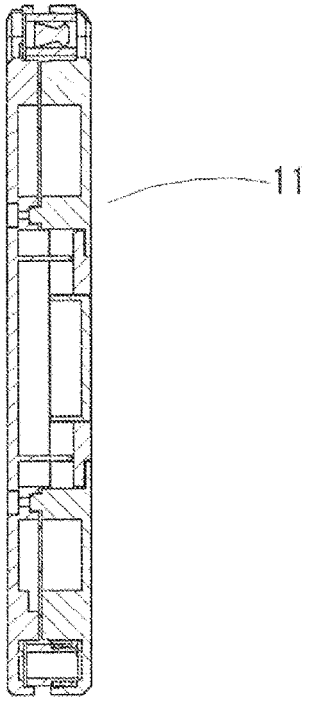
FIG. 7 is a lateral central cross-sectional view of the air gun magazine case according to the first embodiment.

The reference numeral 11 denotes a magazine case. In the first embodiment, the magazine case 11 is oval in shape. As shown in FIG. 6, the magazine case 11 is hollow. The interior of the magazine case 11 includes a cartridge assembly housing section 12 and a cartridge assembly guide 13. The cartridge assembly housing section 12 is hollow and disposed along the outer circumference. The cartridge assembly guide 13 is shaped like a wall and disposed inward of the cartridge assembly housing section 12 to separate the cartridge housing section 12 from a central portion. The width of the cartridge assembly housing section 12 is set in accordance with the outside diameter of unitary cartridges 31, 31A, 31B, 31C which form a cartridge assembly 33 to be housed.

Although the magazine case 11 is oval in shape in the present embodiment, it may alternatively be formed in a triangular shape, a rectangular shape, or any other shape in accordance with the shape of an air gun as far as it receives the cartridge assembly guide 13.

The reference numeral 14 denotes a cover. The reference numeral 15 denotes an opening in the magazine case 11. The cover 14 is used to cover or uncover the opening 15.

Figure 1:
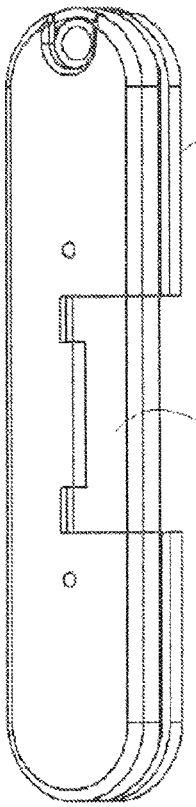
FIG. 1 is a front view of an air gun magazine case according to a first embodiment of the present invention.
Figure 2:
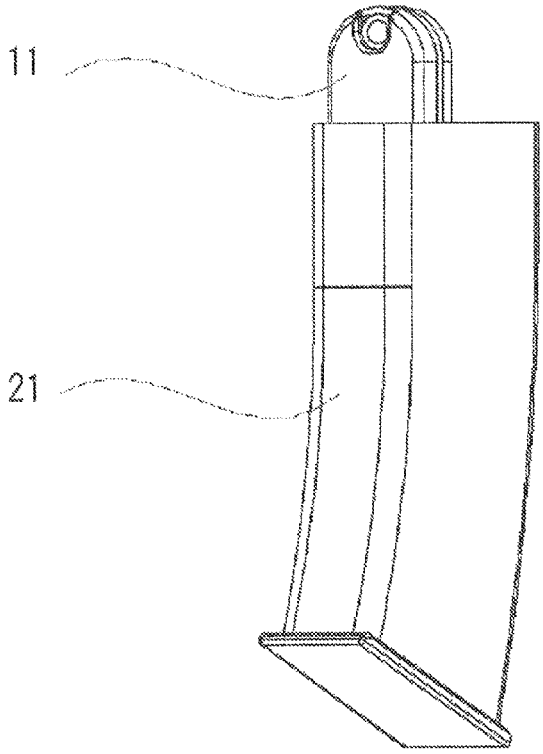
FIG. 2 is a front view illustrating the air gun magazine case according to the first embodiment when it is housed in a magazine stand.
Figure 3:
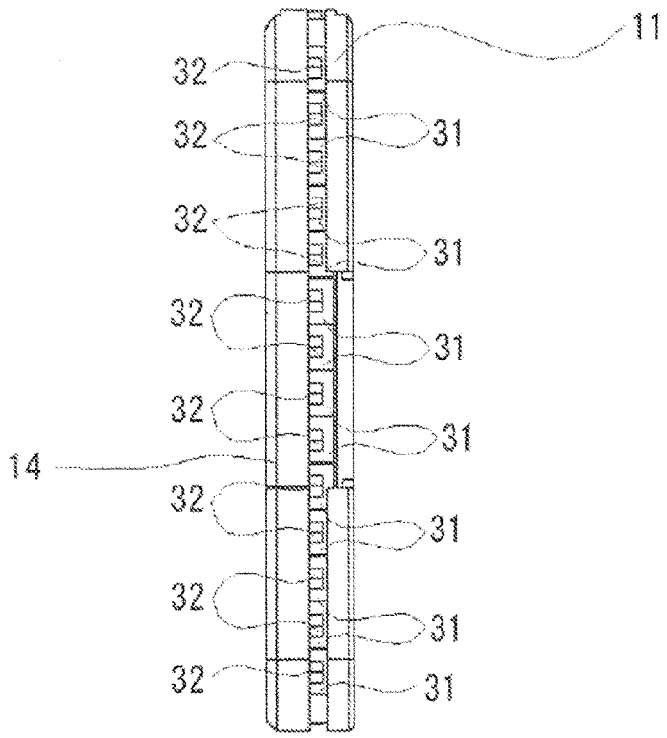
FIG. 3 is a side view of the air gun magazine case according to the first embodiment.
Figure 4:
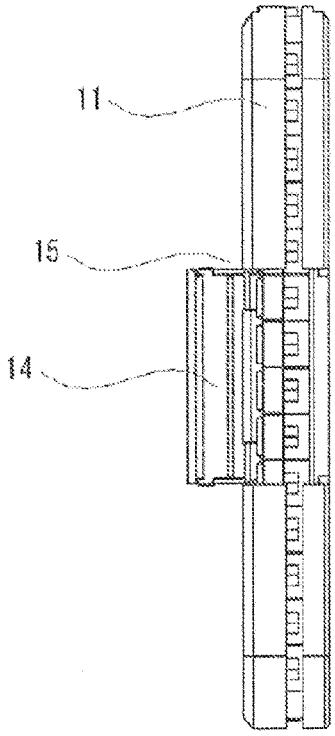
FIG. 4 is a side view illustrating the air gun magazine case according to the first embodiment when its cover is opened in a state shown in FIG. 3.

The magazine case 11 is inserted into and set in an air gun main body that shoots a bullet by using air or other gas. Alternatively, the magazine case 11 may be housed in a magazine stand 21 as shown in FIG. 2 and then inserted into and set in the air gun main body.

Referring to FIGS. 8 to 11, the reference numerals 31, 31A, 31 B and 31C denote a unitary cartridge. The unitary cartridge 31 includes a leading-end unitary cartridge 31A, a trailing-end unitary cartridge 31B, and an intermediate unitary cartridge 31C. The unitary cartridge 31 (31A, 31B, 31C) includes a hollow cylindrical portion 35. The hollow cylindrical portion 35 includes a hollow 34. The hollow 34 is sized to house a bullet.

Figure 8:
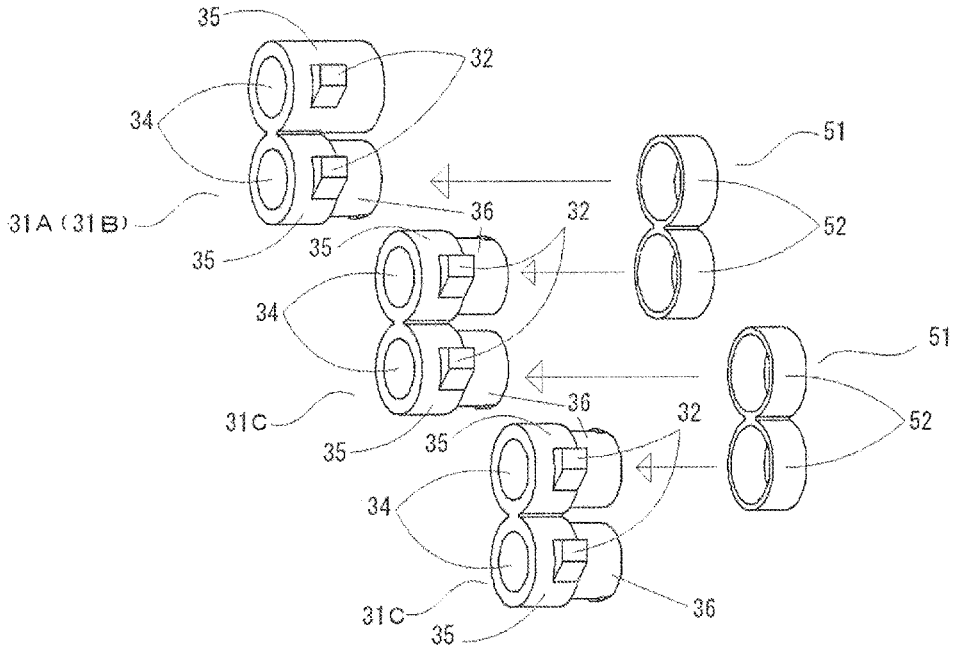
FIG. 8 is a perspective view of air gun unitary cartridges according to the first embodiment.
Figure 9:
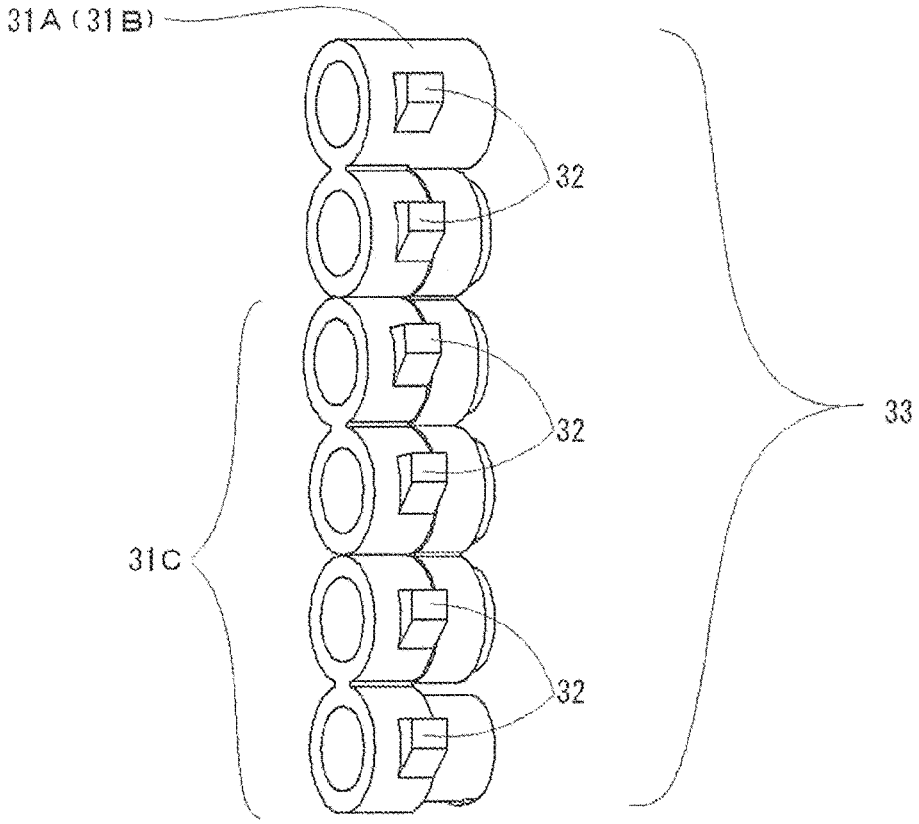
FIG. 9 is a partially enlarged perspective view of the air gun cartridge assembly according to the first embodiment.

As shown in FIG. 8, the unitary cartridge 31 (31A, 31B, 31C) forms one unit when two cylindrical portions having the hollow 34 are lined up. As shown in FIG. 8, the intermediate unitary cartridge 31C includes a small-diameter portion 36. The outer circumference of a leading end of the small-diameter portion 36, which is positioned forward of a central portion, has a small diameter.

The reference numeral 51 shown in FIG. 8 denotes a connector. The connector 51 is obtained by coupling two rings 52 together. The inside diameter of each of the two rings 52 of the connector 51 is designed to fit the outside diameter of the small-diameter portion 36 of the unitary cartridge 31, 31A, 31B, 31C.

The leading-end unitary cartridge 31A and the trailing-end unitary cartridge 31B, which form both ends of the cartridge assembly 33, do not have a small-diameter leading-end outer circumference. The reason is that the leading-end outer circumferences of the leading-end unitary cartridge 31A and trailing-end unitary cartridge 31B need not be coupled to the connector 51 as they are not to be connected to the other unitary cartridges (31A, 31B, 31C).

The connector 51 is fit-coupled to the small-diameter portions 36 of neighboring unitary cartridges 31, 31A, 31B, 31C, which are at the leading end of the hollow cylindrical portion 35 having the hollow 34. The unitary cartridges 31 (31A, 31B, 31C) are then pivotally coupled to each other by the connector 51. Consequently, the cartridge assembly 33, in which the intermediate unitary cartridges 31C are continuously disposed between the leading-end unitary cartridge 31A and the trailing-end unitary cartridge 31B, is formed into a strip shape or into a caterpillar shape.

Figure 5:
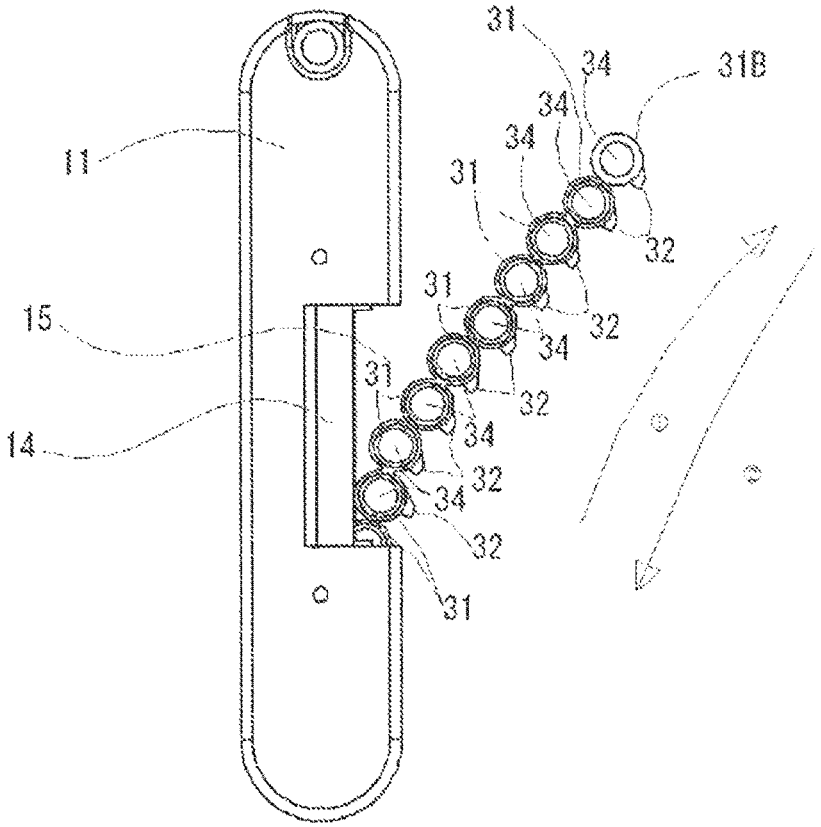
FIG. 5 is a front view illustrating the air gun magazine case according to the first embodiment when its cover is opened to house and remove an air gun cartridge assembly.

The unitary cartridges 31, 31A, 31B, 31C are allowed to pivot on the coupling portion between the small-diameter portion 36 and the connector 51. Therefore, the entire cartridge assembly 33 is transformable as shown in FIG. 5.

The reference numeral 32 denotes a latch of the leading-end unitary cartridge 31A, the trailing-end unitary cartridge 31B, and the intermediate unitary cartridges 31C. In the present embodiment, the latch 32 is an outwardly protruding claw. The latch 32 is formed on the surface of the unitary cartridge 31 and oriented outward.

The reference numeral 41 denotes a cartridge transport unit. The cartridge transport unit 41 is latched by the latch 32 to transport the cartridge assembly.

The cartridge transport unit 41 is attached to the magazine case 11. Further, the cartridge transport unit 41, which is placed in the air gun main body, is disposed to engage with the leading-end unitary cartridge 31A, the trailing-end unitary cartridge 31B, or the intermediate unitary cartridges 31C, which are included in the cartridge assembly 33 in the magazine case 11.

As shown in FIG. 6, the cartridge transport unit 41 engages with the latch (claw) 32 and presses the latch 32 downward to feed the strip-shaped cartridge assembly 33 forward. The cartridge transport unit 41 is driven upon the activation of a trigger of the air gun, which is not shown. When the cartridge transport unit 41 is driven, the cartridge assembly 33 moves forward.

When bullets are to be loaded, the cartridge assembly 33 is removed from the magazine case 11 and unfolded. The bullets are then inserted into the hollows 34 in the unitary cartridges 31 (31A, 31B, 31C).

Subsequently, the cartridge assembly 33 is inserted into the magazine case 11 in the direction of arrow 2 in FIG. 5 from the opening 15 uncovered by opening the cover 14, with the leading-end unitary cartridge 31A forward, as shown in FIG. 5.

As a result, the cartridge assembly 33 is formed into an oval shape and housed in the magazine case 11 as shown in FIG. 6.

When the unitary cartridges 31 (31A, 31B, 31C) in the cartridge assembly 33 are emptied of bullets and the cartridge assembly 33 needs to be removed from the magazine case 11, the above-described procedure is reversed by removing the cartridge assembly 33 in an opposite direction, that is, in the direction of arrow 1 in FIG. 5.

Figure 10:
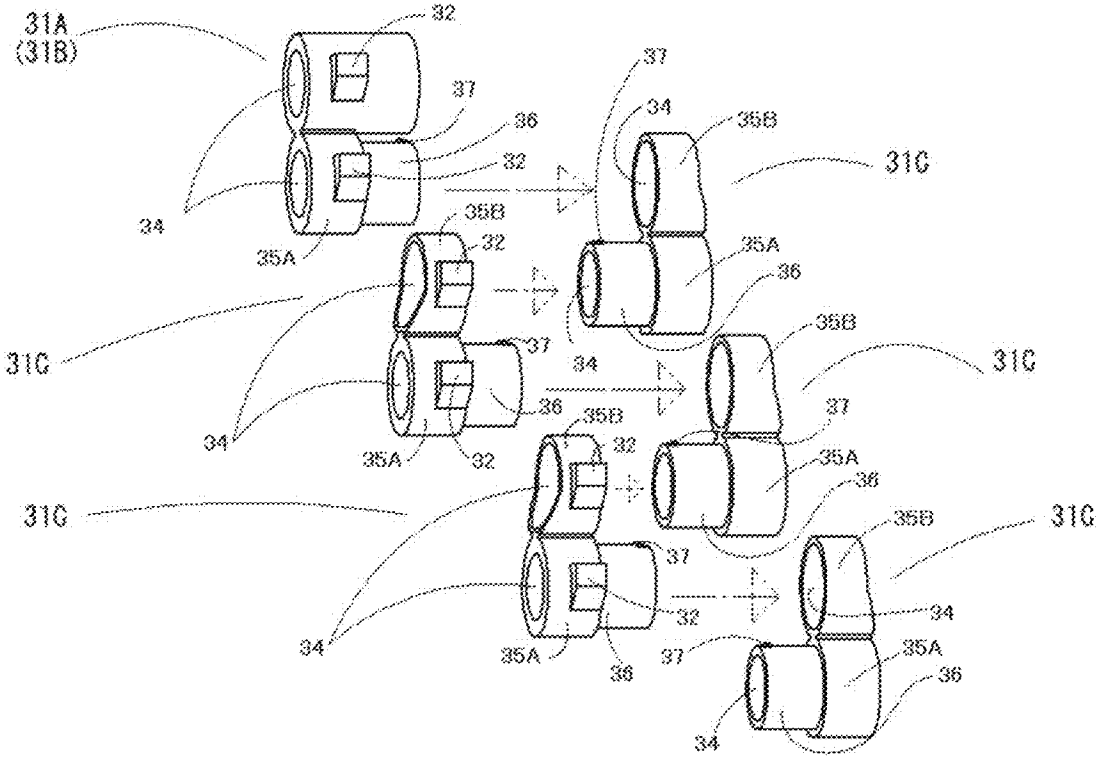
FIG. 10 is a perspective view of the air gun unitary cartridges according to a second embodiment of the present invention.
Figure 11:
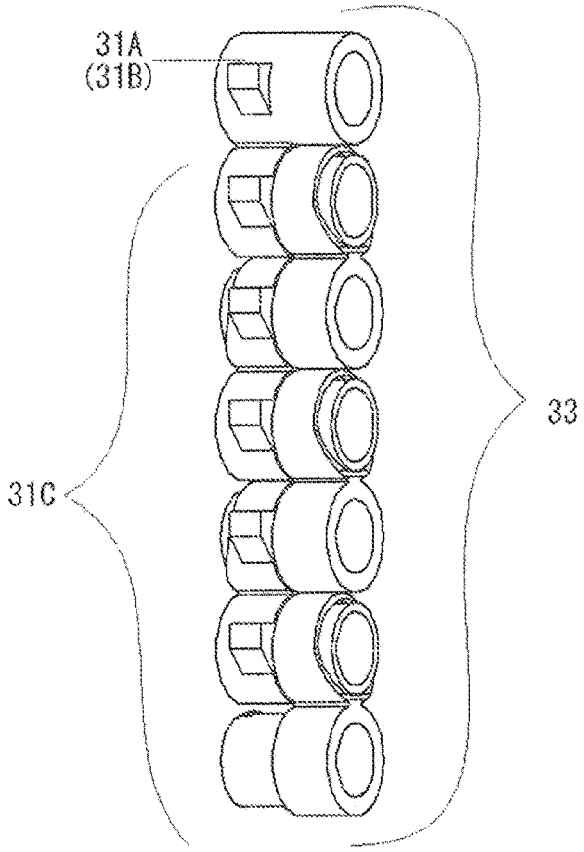
FIG. 11 is a perspective view of the air gun cartridge assembly according to the second embodiment.
Figure 12:
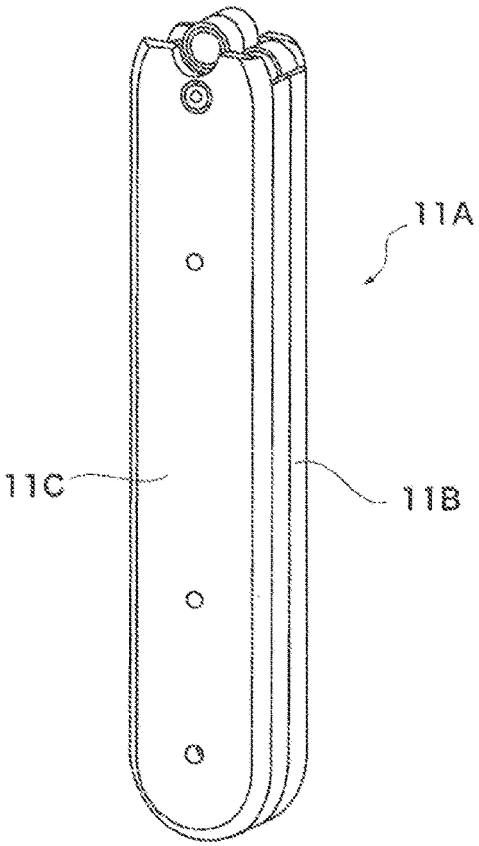
FIG. 12 is a perspective view of the air gun cartridge assembly according to a third embodiment of the present invention.

FIGS. 10 and 11 are perspective views illustrating a second embodiment of the present invention. In the second embodiment, the small-diameter portion 36 of a unitary cartridge 31 is fit-coupled to a neighboring unitary cartridge 31 without using a connector so that the unitary cartridges are directly pivotally coupled to each other to form the cartridge assembly 33 into a strip shape or into a caterpillar shape.

In other words, the unitary cartridges 31A, 31B, 31C are configured so that two sets of hollow cylindrical portions 35A, 35B having the hollow 34 are arranged to form one unit as shown in FIGS. 10 and 11.

The hollow cylindrical portion 35A is formed to be longer than the hollow cylindrical portion 35B. The leading-end unitary cartridge 31A, the trailing-end unitary cartridge 31B, and the intermediate unitary cartridges 31C, which are the unitary cartridges, have the small-diameter portion 36. As shown in FIG. 10, the outer circumference of a leading end of the small-diameter portion 36, which is positioned forward of a central portion, has a small diameter.

The unitary cartridges 31 (31A, 31B, 31C) are allowed to pivot on the coupling portion between the small-diameter portion 36 of a unitary cartridge 31 (31A, 31B, 31C) and the hollow cylindrical portion 35B of a neighboring unitary cartridge 31 (31A, 31B, 31C). Therefore, the entire cartridge assembly 33 is transformable as shown in FIG. 5.

The leading-end outer circumferences of the leading-end unitary cartridge 31A and trailing-end unitary cartridge 31B are not small in diameter. The reason is that they are not to be connected to the other unitary cartridges 31, 31A, 31B, 31C.

The latch 32 is formed only on the unitary cartridge 31C, which is shown on the left side of FIG. 10. Alternatively, however, the latch 32 may be formed on all unitary cartridges 31A, 31B, 31C.

The reference numeral 37 denotes a hook. The hook 37 is formed on the outer circumference of the small-diameter portion 36 and shaped like a convex that bulges outward.

The small-diameter portion 36 at the leading end of the hollow cylindrical portion 35 of a unitary cartridge 31A, 31B, 31C is fit-coupled to the hollow 34 in a neighboring unitary cartridge 31A, 31B, 31C in order to couple the unitary cartridges 31 (31A, 31B, 31C) together. Consequently, the intermediate unitary cartridges 31C are continuously disposed in a strip shape between the leading-end unitary cartridge 31A and the trailing-end unitary cartridge 31B to form the cartridge assembly 33.

The hook 37 ensures that the unitary cartridges 31A, 31B, 31C engage with each other in a moderate manner.

In the second embodiment, the unitary cartridges 31A, 31B, 31C into which bullets are to be inserted are directly pivotally coupled to each other to form a strip-shaped cartridge assembly 33 in which the unitary cartridges 31A, 31B, 31C are continuously disposed.

FIGS. 13 to 17 illustrate a third embodiment of the present invention. In the third embodiment, a cartridge assembly 33A is shaped like an endless strip or a caterpillar.

Figure 14:
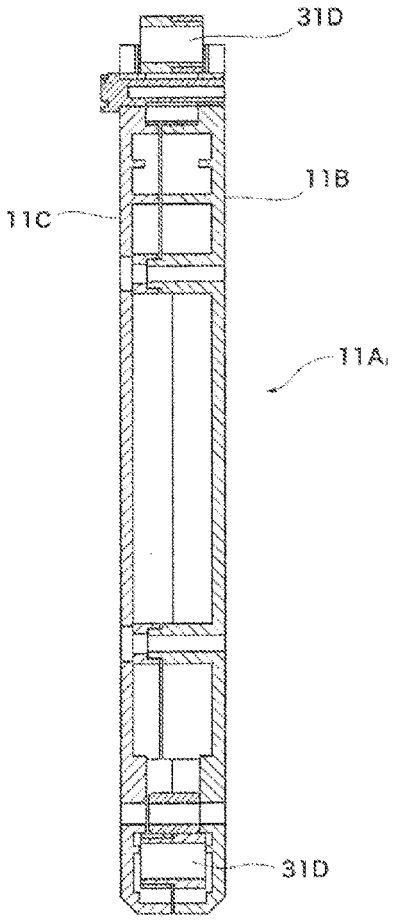
FIG. 14 is a side view of the air gun magazine case according to the third embodiment.

The reference numeral 11A denotes a magazine case. In the present embodiment, the magazine case 11A is hollow and shaped like an oval. As shown in FIG. 14, the magazine case 11A is assembled by engaging a magazine case component part 11B with another magazine case component part 11C. The magazine case component parts 11B, 11C are inwardly concaved and U-shaped when viewed in a cross-sectional view.

Figure 15:
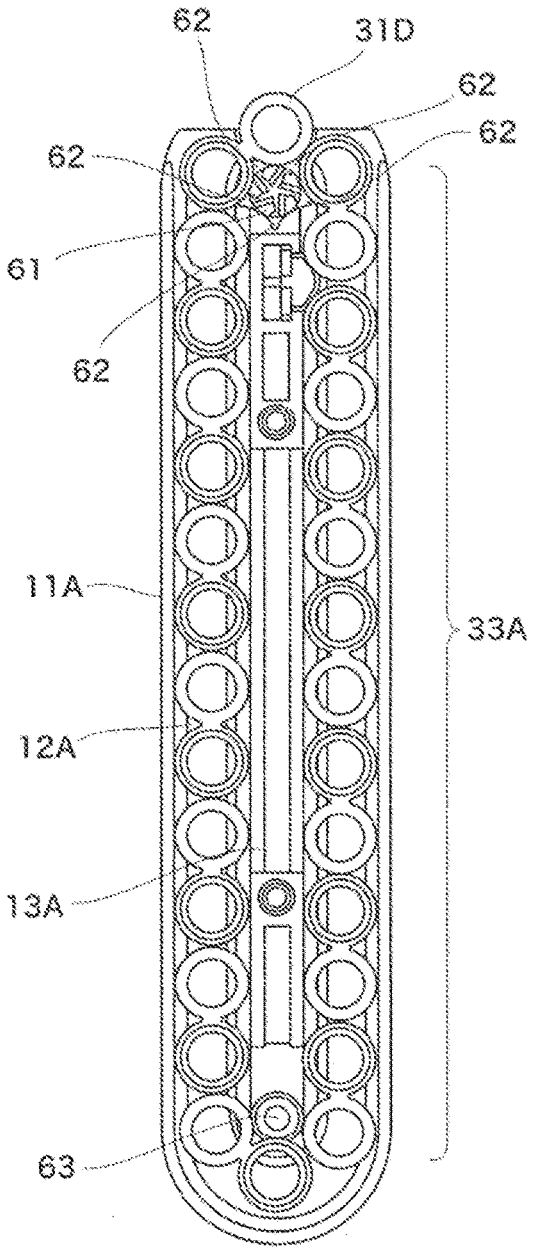
FIG. 15 is a front cross-sectional view illustrating the air gun magazine case when it houses the air gun cartridge assembly according to the third embodiment.

As shown in FIG. 15, the interior of the magazine case 11A includes a cartridge assembly housing section 12A and a cartridge assembly guide 13A. The cartridge assembly housing section 12A is hollow and disposed along the outer circumference. The cartridge assembly guide 13A is shaped like a wall and disposed inward of the cartridge assembly housing section 12A to separate the cartridge housing section 12A from a central portion. The width of the cartridge assembly housing section 12A is set in accordance with the outside diameter of unitary cartridges 31D, which form the cartridge assembly 33A to be housed.

The reference numeral 61 denotes a cartridge transport unit. The cartridge transport unit 61 is a mechanism that feeds the unitary cartridges 31D. In the third embodiment, the cartridge transport unit 61 is formed of a rotation shaft that is disposed near the upper end of the magazine case 11A. The rotation shaft of the cartridge transport unit 61 is shaped like a gear or a star and provided with a plurality of teeth 62. The teeth 62 of the rotation shaft are arranged to fit into a gap between the outer circumferences of the unitary cartridges 31D. In the present embodiment, the rotation shaft has five teeth 62.

When the cartridge transport unit 61 rotates, its teeth 62 catch in a groove 38 between neighboring unitary cartridges 31D to transport the cartridge assembly 33A. As the cartridge transport unit 61 rotates, the cartridge assembly 33A moves in a predetermined direction by an amount equivalent to one unitary cartridge 31D.

The groove 38 in the third embodiment corresponds to the latch 32 in the first embodiment and provides the same operational advantage as the latch 32 in the first embodiment.

In addition to the teeth 62, an anti-rotation groove into which the cartridge transport unit 61 clicks is provided to prevent an excessive rotation of the cartridge transport unit 61.

The cartridge transport unit 61 rotationally transports the unitary cartridges 31D by an amount equivalent to one unitary cartridge 31D upon each activation of the trigger of the air gun.

The reference numeral 63 denotes a cartridge transport assistance unit. The cartridge transport assistance unit 63 is attached to an end of the magazine case 11A that is opposite the end to which the cartridge transport unit 61 is attached. The cartridge transport assistance unit 63 is formed of a rotation shaft. A roller is used to rotate the cartridge transport assistance unit 63 in order to reduce resistance, thereby assuring unobstructed rotation. The cartridge transport assistance unit 63 is provided with an independent suspension in order to prevent the cartridge assembly 33A from bending. The cartridge transport assistance unit 63 is structured so that its spring removes a bend from the cartridge assembly 33A.

Figure 13:
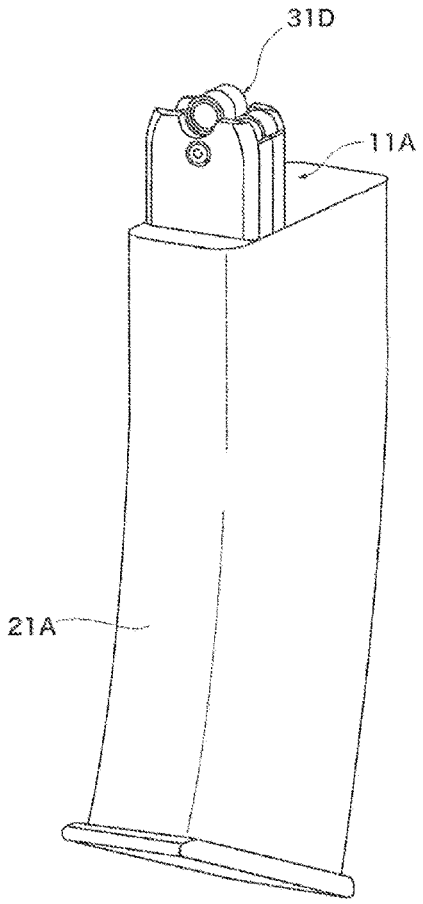
FIG. 13 is a perspective view illustrating the air gun magazine case according to the third embodiment when it is housed in the magazine stand.

The magazine case 11A is inserted into and set in the air gun main body that shoots a bullet by using air or other gas. Alternatively, the magazine case 11A may be housed in a magazine stand 21A as shown in FIG. 13 and then inserted into and set in the air gun main body.

Figure 16:
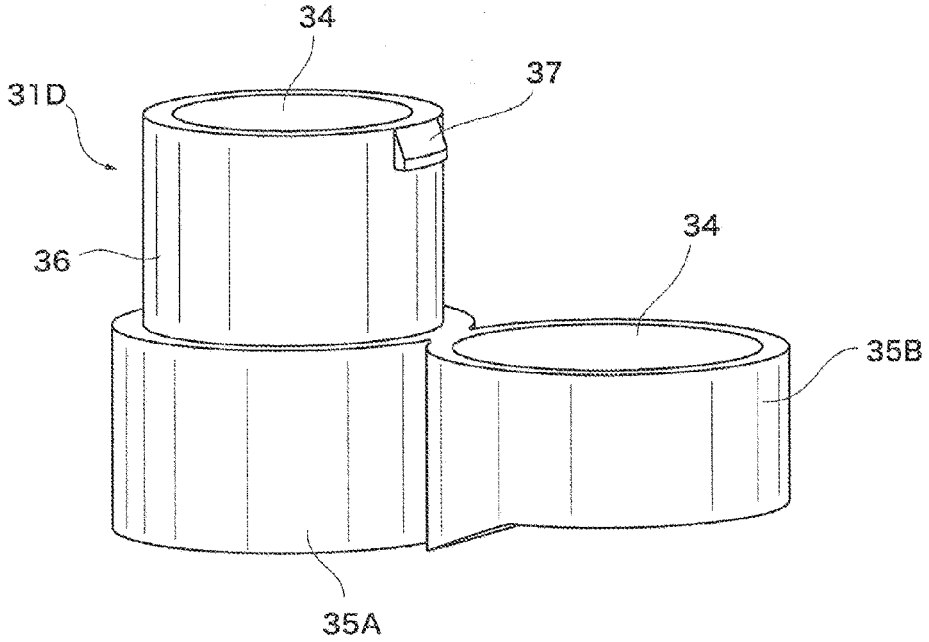
FIG. 16 is a perspective view of an air gun unitary cartridge according to the third embodiment.
Figure 17:
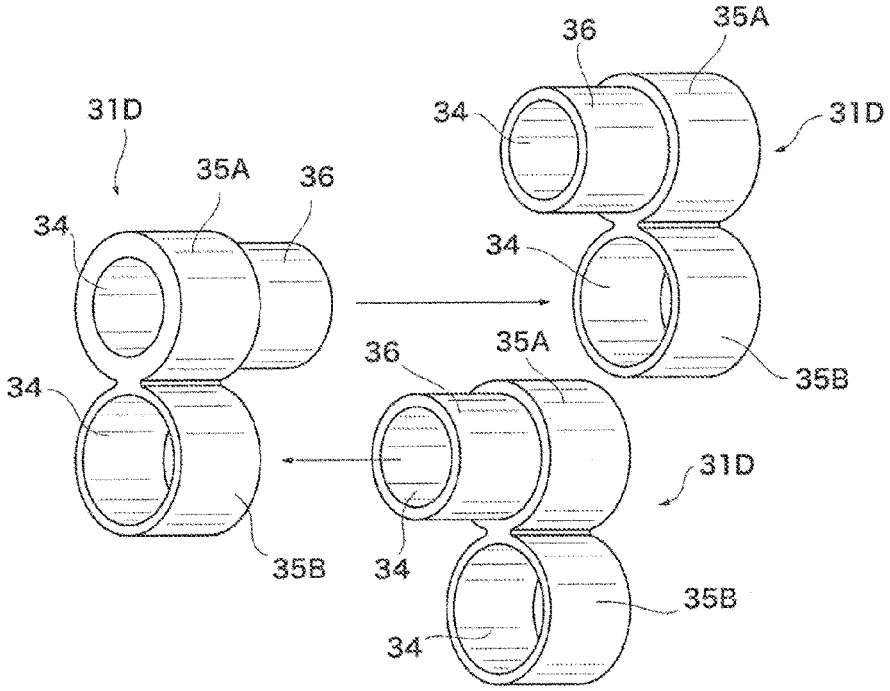
FIG. 17 is a perspective view of air gun unitary cartridges according to the third embodiment.

The reference numeral 31D denotes a unitary cartridge. As shown in FIGS. 16 and 17, the unitary cartridge 31D includes the hollow cylindrical portion 35. The hollow cylindrical portion 35 includes the hollow 34. The hollow 34 is sized to house a bullet.

The third embodiment is similar to the second embodiment in that the unitary cartridges 31D are directly pivotally coupled to each other by fit-coupling the small-diameter portion 36 of one unitary cartridge 31D to another unitary cartridge 31D without using a connector in order to form the cartridge assembly 33A into an endless strip shape.

As shown in FIGS. 16 and 17, the unitary cartridge 31D forms one unit when two hollow cylindrical portions 35A, 35B having the hollow 34 are lined up.

The hollow cylindrical portion 35A is formed to be longer than the hollow cylindrical portion 35B. As shown in FIGS. 16 and 17, the unitary cartridge 31D has the small-diameter portion 36. The outer circumference of a leading end of the small-diameter portion 36, which is positioned forward of a central portion, has a small diameter.

The unitary cartridges 31D are allowed to pivot on the coupling portion between the small-diameter portion 36 of a unitary cartridge 31D and the hollow cylindrical portion 35B of a neighboring unitary cartridge 31D. Therefore, the entire cartridge assembly 33A is transformable and may be, for instance, in oval shape as shown in FIG. 15.

The small-diameter portion 36 at the leading end of the hollow cylindrical portion 35A of a unitary cartridge 31D is fit-coupled into the hollow 34 in the hollow cylindrical portion 35B of a neighboring unitary cartridge 31D while the small-diameter portion 36 of one unitary cartridge 31D is positioned opposite the small-diameter portion 36 of another unitary cartridge 31D with their leading ends facing each other. As a result, the unitary cartridges 31D are coupled as shown in FIG. 15 to form the cartridge assembly 33A that is continuously formed in an endless strip shape.

The hook 37 ensures that the unitary cartridges 31D engage with each other in a moderate manner.

In the third embodiment, the unitary cartridges 31D into which bullets are to be inserted are directly pivotally coupled to each other to form a strip-shaped or caterpillar-shaped cartridge assembly 33A in which the unitary cartridges 31D are continuously disposed.

When a bullet is to be loaded into each unitary cartridge 31D, the magazine case component part 11B is disengaged from the magazine case component part 11C to expose the interior of the magazine case 11A.

Next, the cartridge assembly 33A is removed from the magazine case 11A and unfolded. A bullet is then loaded into the hollow 34 in each unitary cartridge 31D.

Subsequently, the cartridge assembly 33A is housed into the oval magazine case 11A as shown in FIG. 15. When the cartridge assembly 33A is housed into the magazine case 11A, the unitary cartridge 31D located at the upper end is exposed from the magazine case 11A as shown in FIG. 15 so that bullets can be supplied to the air gun main body. The unitary cartridge 31D is located at the lower end as shown in FIG. 14.

When the unitary cartridges 31D in the cartridge assembly 33A are emptied of bullets and the cartridge assembly 33A needs to be removed from the magazine case 11A, the above-described procedure is performed in reverse order.

When the magazine case 11A is set in the air gun main body and the cartridge transport unit 61 rotates upon the activation of the trigger of the air gun, the teeth 62 of the cartridge transport unit 61 catch in the groove 38 between neighboring unitary cartridges 31D to rotate the cartridge transport unit 61. As the cartridge transport unit 61 rotates, the cartridge assembly 33A in an endless strip shape moves in a predetermined direction by an amount equivalent to one unitary cartridge 31D.

In the third embodiment, the unitary cartridges 31D into which bullets are to be inserted are pivotally coupled to each other to form the cartridge assembly 33A in which the unitary cartridges 31D are continuously disposed. Therefore, the unitary cartridges are transformably coupled to each other to form a transformable cartridge assembly. Consequently, the cartridge assembly may be formed in an endless strip shape.

Figure 18:
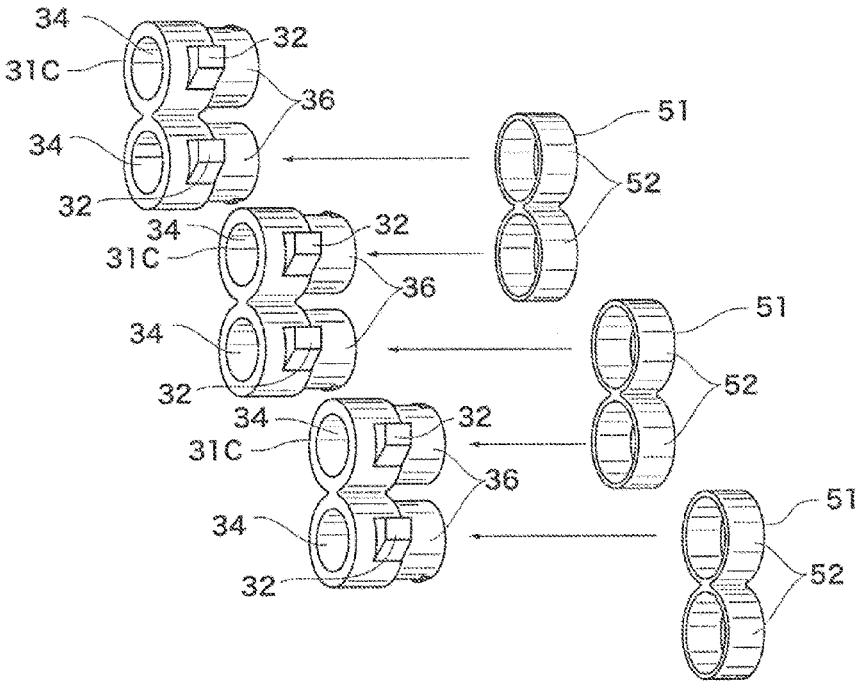
FIG. 18 is a perspective view of the air gun unitary cartridges according to a fourth embodiment of the present invention.
Figure 19:
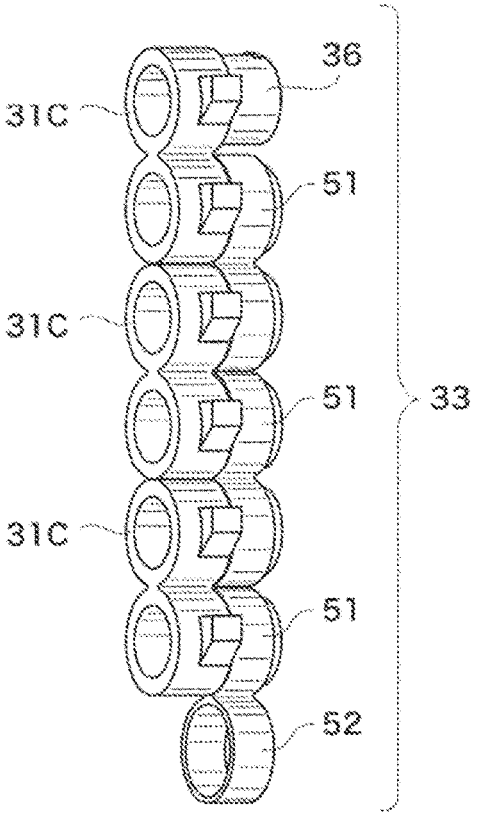
FIG. 19 is a partially enlarged perspective view of the air gun cartridge assembly according to the fourth embodiment.

A fourth embodiment of the present invention will now be described with reference to FIGS. 18 and 19. In the fourth embodiment, the intermediate unitary cartridges 31C are used entirely in place of the leading-end unitary cartridge 31A and trailing-end unitary cartridge 31B, which are used in the first embodiment. Further, the small-diameter portion 36 located at both ends are fit into a ring 52 in order to form an endless cartridge assembly 33.

Figure 20:
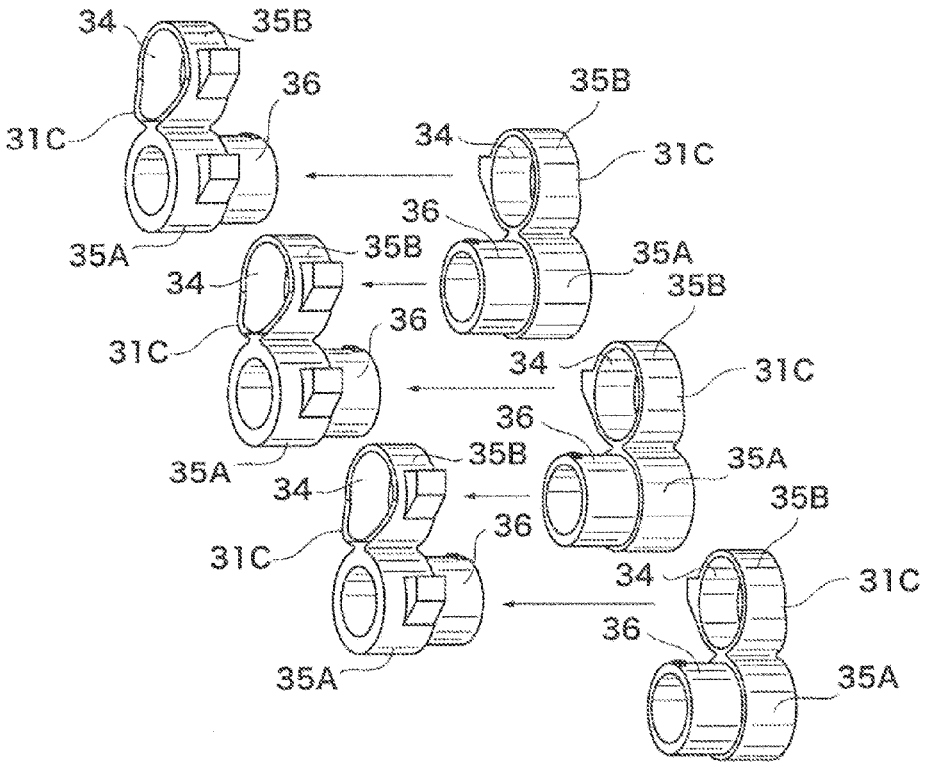
FIG. 20 is a perspective view of the air gun unitary cartridges according to a fifth embodiment of the present invention.
Figure 21:
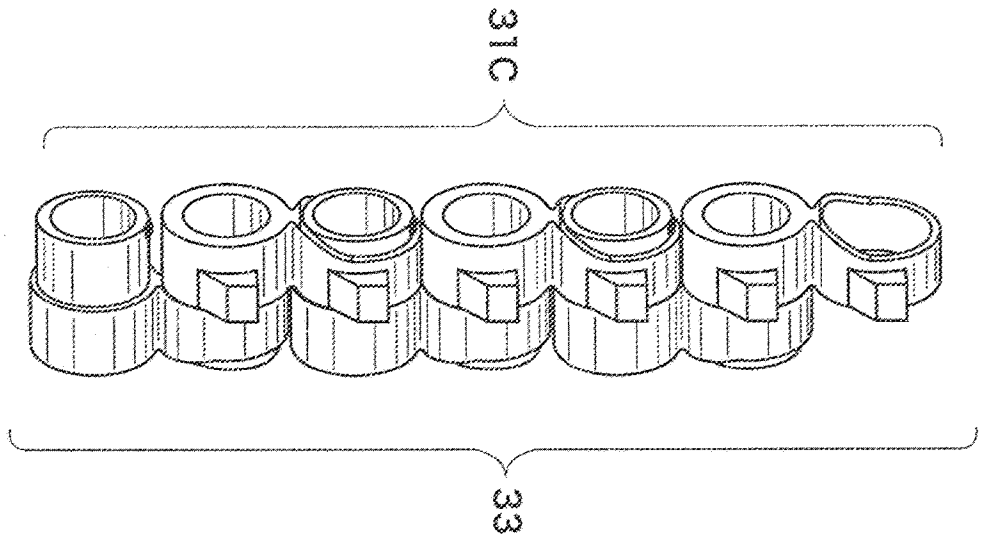
FIG. 21 is a perspective view of the air gun cartridge assembly according to the fifth embodiment.

A fifth embodiment of the present invention will now be described with reference to FIGS. 20 and 21. The fifth embodiment corresponds to the air gun unitary cartridge according to the second embodiment.

More specifically, the unitary cartridges 31C are used entirely in place of the leading-end unitary cartridge 31A and trailing-end unitary cartridge 31B, which are used in the second embodiment. Further, the small-diameter portion 36 located at one end are fit into the hollow 34 in the hollow cylindrical portion 35B located at another end in order to form an endless cartridge assembly 33.

What is claimed is:

1. A cartridge assembly for an air gun, the cartridge assembly comprising:

a plurality of cylindrical unitary cartridges, each of the unitary cartridges including two hollow cylindrical portions, each of the cylindrical portions including a hollow chamber configured to house a bullet, each of the cylindrical portions including a leading end and a small-diameter portion positioned proximate the leading end; and a plurality of fit-coupling connectors for directly, pivotally coupling the unitary cartridges, each of the connectors including two rings, an inner diameter of each of the two rings being configured to fit an outside diameter of the small-diameter portion, one of the rings being coupled to the leading end of the cylindrical portion of a first unitary cartridge and the other of the rings being coupled to the leading end of the cylindrical portion of a second unitary cartridge, wherein the cartridges are advanced by a cartridge transport unit.

2. The cartridge assembly for an air gun according to claim 1, wherein the plurality of unitary cartridges is formed in a continuous loop.

3. The cartridge assembly for an air gun according to claim 1, wherein each of the cylindrical portions further includes a trailing end and a large-diameter portion positioned proximate the trailing end.

4. The cartridge assembly for an air gun according to claim 1, wherein at least one of the unitary cartridges includes an outer circumference provided with a latch.

5. The cartridge assembly for an air gun according to claim 1, further comprising a magazine case for housing the plurality of unitary cartridges.

6. The cartridge assembly for an air gun according to claim 5, wherein the cartridge transport unit is attached to the magazine case.

7. A cartridge assembly for an air gun, comprising:

a plurality of cylindrical unitary cartridges, each of the unitary cartridges including a first hollow cylindrical portion and a second hollow cylindrical portion, each hollow cylindrical portion including a hollow chamber, the hollow chamber of at least the first cylindrical portion being configured to house a bullet, the first hollow cylindrical portion having a leading end, wherein the unitary cartridges are directly pivotally connected to one another, such that a first unitary cartridge is connected to a second unitary cartridge by fit-coupling the leading end of the first hollow cylindrical portion of the first unitary cartridge to the hollow chamber of the second cylindrical portion of the second unitary cartridge, and wherein the cartridges are advanced by a cartridge transport unit.

8. The cartridge assembly for an air gun according to claim 7, wherein the first hollow cylindrical portion of each unitary cartridge includes a length that is longer than a length of the second hollow cylindrical portion.

9. The cartridge assembly for an air gun according to claim 7, wherein the plurality of unitary cartridges is connected in a continuous loop.

10. The cartridge assembly for an air gun according to claim 7, wherein the leading end of the first hollow cylindrical portion of the first unitary cartridge is inserted through a leading end of the second cylindrical portion of the second unitary cartridge.

11. The cartridge assembly for an air gun according to claim 7, wherein at least one of the unitary cartridges includes an outer circumference provided with a latch.

12. The cartridge assembly for an air gun according to claim 7, further comprising a magazine case for housing the plurality of unitary cartridges.

13. The cartridge assembly for an air gun according to claim 12, wherein the cartridge transport unit is attached to the magazine case.

14. The cartridge assembly for an air gun according to claim 7, wherein the leading end of the first hollow cylindrical portion of each unitary cartridge includes a small-diameter portion.

* * * * *